US010887688B2

(12) United States Patent
Saito et al.

(10) Patent No.: US 10,887,688 B2
(45) Date of Patent: Jan. 5, 2021

(54) AUDIO SIGNAL PROCESSING APPARATUS, AUDIO SIGNAL PROCESSING METHOD, AND STORAGE MEDIUM THAT UPDATE CURRENTLY USED PARAMETER UPON RECEIVING CHANGE OPERATION INSTRUCTION

(71) Applicant: YAMAHA CORPORATION, Hamamatsu (JP)

(72) Inventors: Kosuke Saito, Hamamatsu (JP); Masaaki Okabayashi, Hamamatsu (JP)

(73) Assignee: YAMAHA CORPORATION, Hamamatsu (JP)

( * ) Notice: Subject to any disclaimer, the term of this patent is extended or adjusted under 35 U.S.C. 154(b) by 0 days.

(21) Appl. No.: 16/566,065

(22) Filed: Sep. 10, 2019

(65) Prior Publication Data

US 2020/0092642 A1 Mar. 19, 2020

(30) Foreign Application Priority Data

Sep. 13, 2018 (JP) ..... 2018-171578
Feb. 1, 2019 (JP) ..... 2019-016637

(51) Int. Cl.
*H04R 3/00* (2006.01)
*H04R 1/22* (2006.01)

(52) U.S. Cl.
CPC ..... *H04R 3/00* (2013.01); *H04R 1/22* (2013.01)

(58) Field of Classification Search
None
See application file for complete search history.

(56) References Cited

U.S. PATENT DOCUMENTS

| | | | |
|---|---|---|---|
| 7,518,055 | B2 | 4/2009 | Zartarian |
| 2011/0305349 | A1 | 12/2011 | Asada |
| 2017/0117003 | A1 | 4/2017 | Takasu |
| 2019/0222332 | A1 | 7/2019 | Okabayashi |

FOREIGN PATENT DOCUMENTS

| | | | |
|---|---|---|---|
| JP | 2004247898 | A | 9/2004 |
| JP | 2010521080 | A | 6/2010 |
| JP | 2012004734 | A | 1/2012 |
| JP | 2016015711 | A | 1/2016 |
| WO | 2008109210 | A1 | 9/2008 |
| WO | 2018061720 | A1 | 4/2018 |

OTHER PUBLICATIONS

English machine translation of WO 2018061720 (Year: 2018).*
Extended European Search Report issued in European Appln. No. 19196740.5 dated Dec. 20, 2019.
"PM5D/PM5D-RH, Operating and reference sections, Owner's Manual." Jun. 30, 2004. 51 pages. Yamaha Corporation.

* cited by examiner

*Primary Examiner* — James K Mooney
(74) *Attorney, Agent, or Firm* — Rossi, Kimms & McDowell LLP

(57) ABSTRACT

An audio signal processing apparatus includes a receptor that receives specification operation that specifies a parameter set to be used among a plurality of parameter sets and change operation that changes a parameter value included in a specified parameter set, a signal processor that processes an audio signal based on the parameter set that has been specified by the specification operation, and an update processor that updates a currently used parameter set among the plurality of parameter sets when receiving the change operation.

18 Claims, 14 Drawing Sheets

AUDIO SIGNAL PROCESSING APPARATUS, AUDIO SIGNAL PROCESSING METHOD, AND STORAGE MEDIUM THAT UPDATE CURRENTLY USED PARAMETER UPON RECEIVING CHANGE OPERATION INSTRUCTION

CROSS REFERENCE TO RELATED APPLICATIONS

This Nonprovisional application claims priority under 35 U.S.C. § 119(a) on Patent Applications No. 2018-171578 filed in Japan on Sep. 13, 2018 and No. 2019-016637 filed in Japan on Feb. 1, 2019 the entire contents of which are hereby incorporated by reference.

BACKGROUND OF THE INVENTION

1. Field of the Invention

The present invention relates to an audio signal processing apparatus, an audio signal processing method, and a storage medium.

2. Description of the Related Art

For example, as disclosed in Japanese Unexamined Patent Application Publication No. 2004-247898, an audio mixer includes a scene memory that stores a parameter value that indicates content of processing an audio signal. A user, only by instructing a recall of the scene memory, can immediately recall the value that has been set in the past. Accordingly, the user can immediately recall an optimal value for each scene, the optimal value having been set for a scene during a rehearsal of a concert, for example. Such reproducing operation is called "a scene recall."

In addition, National Publication of International Patent Application No. 2010-521080 discloses an effector that selects a parameter from a preset.

In addition, Japanese Unexamined Patent Application Publication No. 2012-004734 discloses a configuration of changing sound pressure according to a type of a headphone.

In addition, Japanese Unexamined Patent Application Publication No. 2016-015711 discloses an audio system in which an appropriate volume is automatically set based on a received audio signal.

A user may adjust a parameter value in a certain scene. However, when a scene changes and a scene recall is performed, the parameter value that has been adjusted is not kept and is switched to a parameter value that is stored in a scene memory. Therefore, even when the user tries to restore the adjusted parameter value, the parameter value is not able to be easily restored.

SUMMARY OF THE INVENTION

In view of the foregoing, the present invention is directed to provide an audio signal processing apparatus, an audio signal processing method, and a storage medium that are able to change a scene while keeping an adjusted parameter value.

An audio signal processing apparatus according to a preferred embodiment of the present invention includes a receptor that receives specification operation that specifies a parameter set to be used among a plurality of parameter sets and change operation that changes a parameter value included in a specified parameter set, a signal processor that processes an audio signal based on the parameter set that has been specified by the specification operation, and an update processor that updates a currently used parameter set among the plurality of parameter sets when receiving the change operation.

According to the present invention, a scene is able to be changed while an adjusted parameter value is kept.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
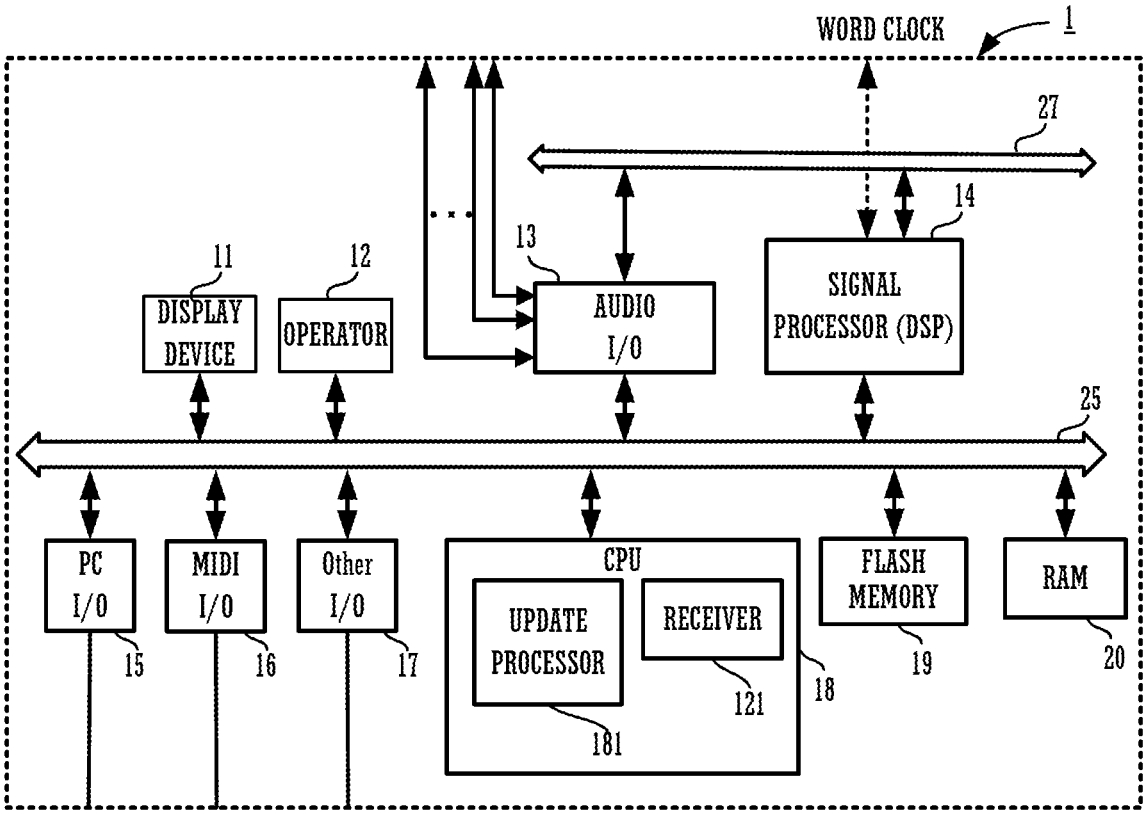
FIG. 1 is a block diagram showing a configuration of a mixer 1.

FIG. 1 is a block diagram showing a configuration of a mixer 1. The mixer 1 is an example of an audio signal processing apparatus according to the present invention. The mixer 1 includes a display 11, an operator 12, an audio I/O (Input/Output) 13, a signal processor 14, a PC I/O 15, a MIDI I/O 16, other I/O 17, a CPU 18, a flash memory 19, and a RAM 20.

The display 11, the operator 12, the audio I/O 13, the signal processor 14, the PC I/O 15, the MIDI I/O 16, the other I/O 17, the CPU 18, the flash memory 19, and the RAM 20 are connected with one another through a bus 25. Further, the audio I/O 13 and the signal processor 14 are also connected to a waveform bus 27 in order to transmit a digital audio signal.

The audio I/O 13 is an interface for receiving an input of an audio signal to be processed in the signal processor 14. The audio I/O 13 includes an analog input port, a digital input port, or the like to receive the input of an audio signal. In addition, the audio I/O 13 is an interface for outputting an audio signal that has been processed in the signal processor 14. The audio I/O 13 includes an analog output port, a digital output port, or the like to output the audio signal.

Each of the PC I/O 15, the MIDI I/O 16, and the other I/O 17 is an interface that is connected to various types of external devices and performs input from or output to the devices. The PC I/O 15 is connected to an external PC, for example. The MIDI I/O 16 is connected to a MIDI compatible device such as a physical controller or an electronic musical instrument, for example. The other I/O 17 is connected to a display, for example. Alternatively, the other I/O 17 is connected to a UI (User Interface) device, such as a mouse or a keyboard. Any standards such as Ethernet (registered trademark) or a USB (Universal Serial Bus) are able to be employed for communication with the external devices. The mode of connection may be wired or wireless.

The CPU 18 is a controller that controls operation of the mixer 1. The CPU 18 reads out a predetermined program stored in the flash memory 19 being a storage to the RAM 20 and performs various types of operation. For example, the CPU 18 executes the program to function as an update processor 181. In addition, the CPU 18 also executes the program to function as a receptor 121. The receptor 121 receives operation from a user through the operator 12. It is to be noted that it is not necessary to store the program in the flash memory 19 of the own device. For example, the program may be downloaded each time from another device such as a server and may be read out to the RAM 20.

The display 11 displays various types of information according to the control of the CPU 18. The display 11 includes an LCD or a light emitting diode (LED), for example.

The operator 12 receives operation to the mixer 1 from a user. The operator 12 includes various types of keys, buttons, rotary encoders, sliders, and the like. In addition, the operator 12 may include a touch panel laminated on the LCD being the display 11.

The signal processor 14 includes a plurality of DSPs for performing various types of signal processing such as mixing processing or effect processing. The signal processor 14 performs effect processing such as mixing processing or equalizing on an audio signal supplied from the audio I/O 13 through the waveform bus 27. The signal processor 14 outputs a signal-processed digital audio signal to the audio I/O 13 again through the waveform bus 27.

Figure 2:
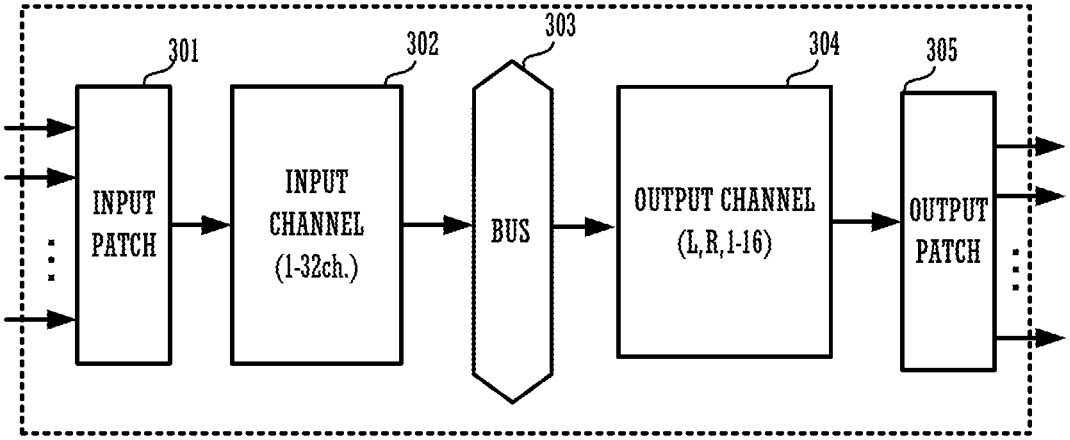
FIG. 2 is an equivalent block diagram of signal processing to be performed in a signal processor 14, an audio I/O 13, and a CPU 18.

FIG. 2 is an equivalent block diagram of signal processing to be performed in a signal processor 14, an audio I/O 13, and a CPU 18. As shown in FIG. 2, the signal processing is functionally performed through an input patch 301, an input channel 302, a bus 303, an output channel 304, and an output patch 305.

The input patch 301 receives an input of an audio signal from a plurality of input ports (an analog input port or a digital input port, for example) in the audio I/O 13 and assigns any one of a plurality of ports to at least one of a plurality of channels (32 ch, for example). As a result, the audio signal is supplied to each channel in the input channel 302.

Figure 3:
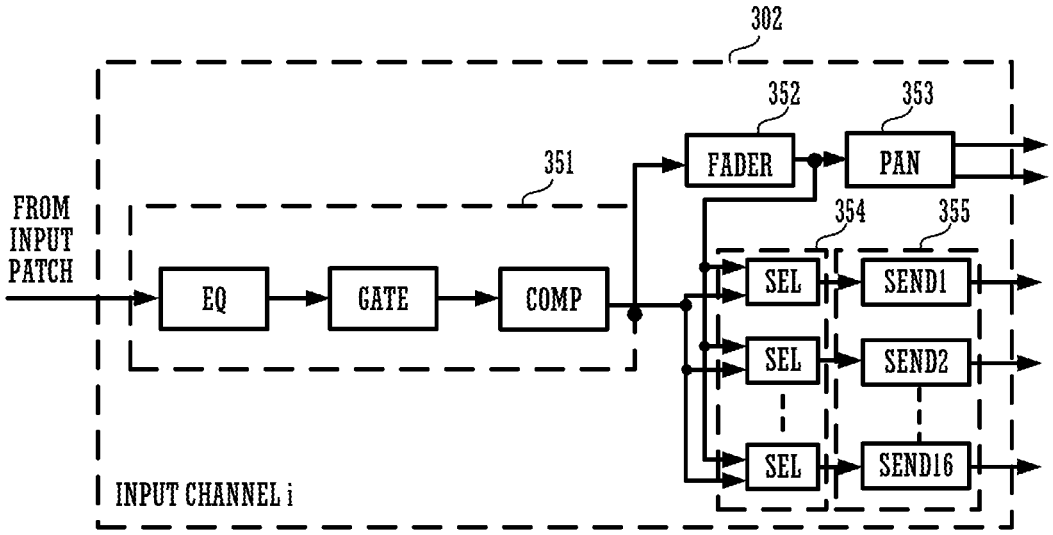
FIG. 3 is a view showing a processing configuration of a certain input channel i.

FIG. 3 is a view showing a processing configuration of a certain input channel i. Each channel of the input channel 302 performs signal processing such as equalizer (EQ), gate (GATE), or compressor (COMP) on the audio signal supplied from the input patch 301, in a signal processing block 351.

The signal-processed audio signal is level-adjusted by a fader (FADER) 352, and then is sent out to the bus 303 in a subsequent stage, through a pan (PAN) 353. The pan 353 adjusts a balance of a signal to be supplied to a stereo bus (two-channel bus being as a master output) of the bus 303.

It is to be noted that a selector, by selection operation from a user, is able to cause a sender 355 in the subsequent stage to receive an input of either the signal to be outputted from the signal processing block 351 or the signal that has been level-adjusted by the fader 352.

In addition, the signal-processed audio signal is level-adjusted by the sender (SEND) 355 through the selector (SEL) 354, and then sent out to the bus 303 in the subsequent stage. The sender 355 is switched by a user to determine whether or not to supply a signal to each SEND bus of the bus 303. In addition, the sender 355 adjusts a level of the signal to be supplied to each SEND bus according to each SEND level that the user has set.

The output channel 304 has 16 channels, for example. At each channel in the output channel 304, various types of signal processing are performed on an audio signal to be inputted, similarly to the input channel. At each channel in the output channel 304, the signal-processed audio signal is sent to the output patch 305. The output patch 305 assigns each channel to any one of a plurality of ports in the analog output port or the digital output port. Accordingly, the signal-processed audio signal is supplied to the audio I/O 13.

The signal processing described above is controlled based on a value of each parameter. The CPU 18 stores a current value (current data) of each parameter in the RAM 20. The CPU 18 updates the current data when a user operates the operator 12.

Figure 4:
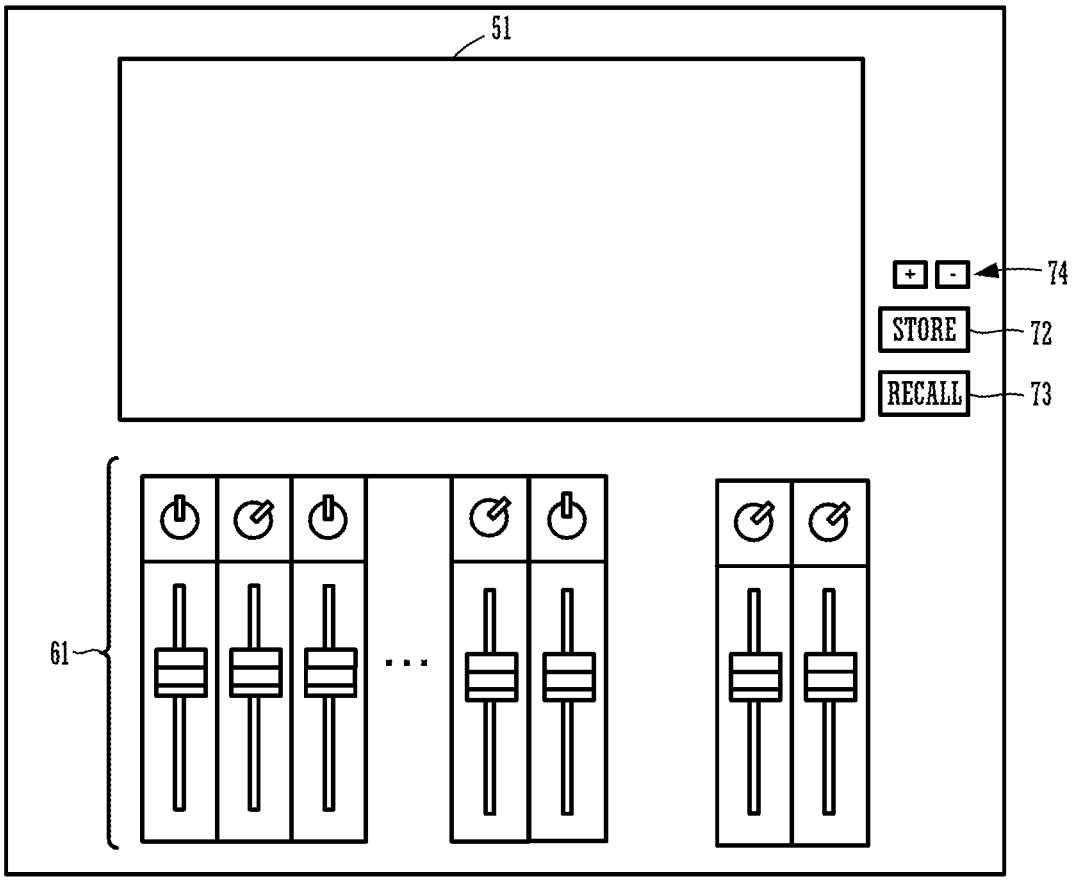
FIG. 4 is a view showing a configuration of an operation panel of the mixer 1.

FIG. 4 is a view showing a configuration of an operation panel of the mixer 1. The operation panel of the mixer 1, as shown in FIG. 4, includes a touch screen 51, a channel strip 61, a STORE button 72, a RECALL button 73, and an increase and decrease button 74. These components correspond to the display 11 and the operator 12 shown in FIG. 1. It is to be noted that, although FIG. 4 only shows the touch screen 51, the channel strip 61, the STORE button 72, the RECALL button 73, and the increase and decrease button 74, in practice, a large number of knobs, switches, or the like may be provided.

The touch screen 51 is the display 11 obtained by stacking the touch panel being one preferred embodiment of the operator 12 is stacked, and displays a GUI (a graphical user interface) screen for receiving operation from a user.

The channel strip 61 is an area in which a plurality of physical controllers that receive operation to one channel are disposed vertically. Although FIG. 4, as the physical controllers, only shows one fader and one knob for each channel, in practice, a large number of knobs, switches, or the like may be provided. In the channel strip 61, a plurality of faders and knobs (16 faders and knobs, for example) disposed on the left hand side correspond to input channels. The two faders and two knobs disposed on the right hand side are physical controllers corresponding to a master output (a two-channel bus). It is to be noted that, in this preferred embodiment, the physical controller, although being displayed as an image, may be a physical operation mechanism such as a slider included in the operator 12, for example.

The STORE button 72 is a button for providing an instruction to store a scene. A user, by operating the STORE button 72, can cause the flash memory 19 to memorize (store) current data as a piece of scene data. However, the scene data only includes information on a bank to be used, and does not include a parameter value. The parameter value is separately stored as library data. The bank and the library data will be described later.

A user can select a scene to be saved and recalled among a plurality of scenes by operating the increase and decrease button 74. A user switches scenes by operating the RECALL button 73 to call (recall) a necessary scene.

Figure 5:
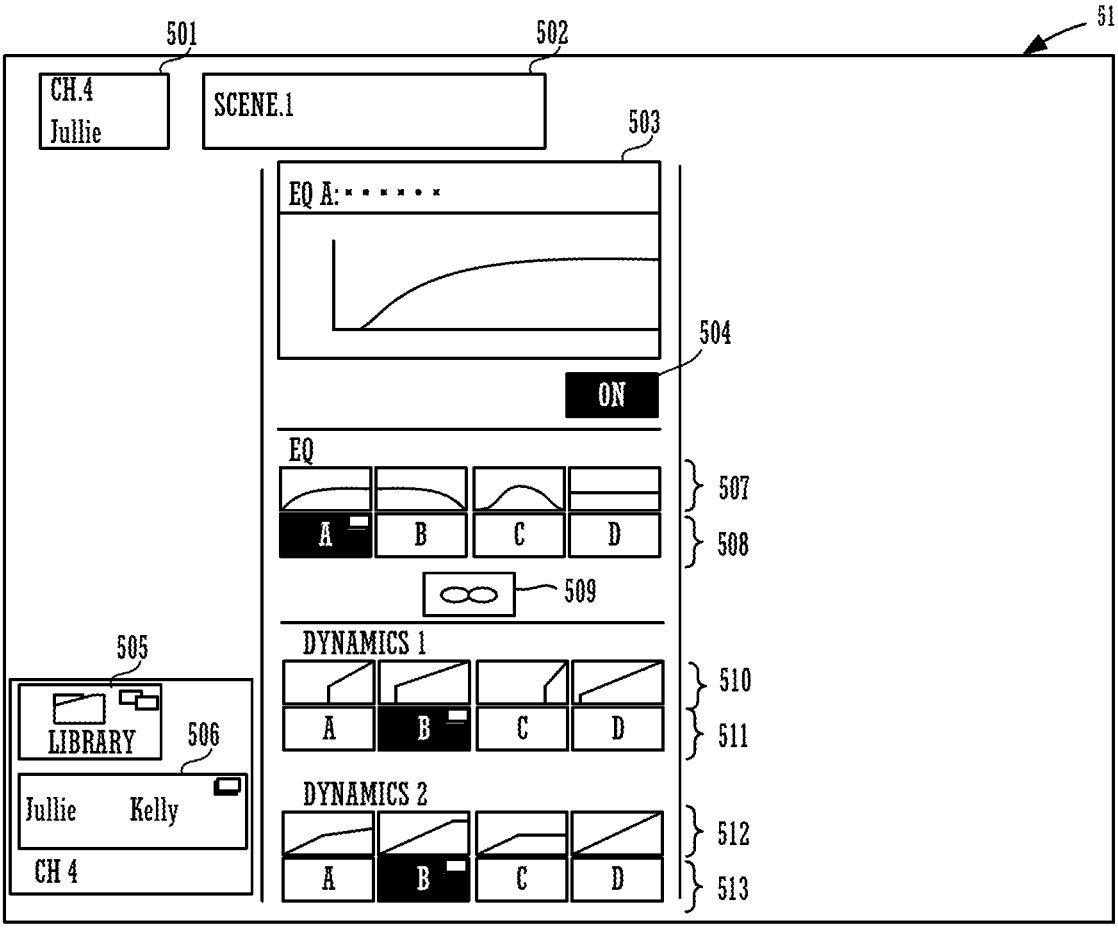
FIG. 5 is a view showing an example of a GUI.

FIG. 5 is a view showing an example of a GUI. The example of FIG. 5 is a GUI (a channel viewer) for displaying processing content of each input channel to a user and making an adjustment. FIG. 5 shows a channel viewer of the input channel 4 as an example.

The channel viewer displays a channel name 501, a scene name 502, a characteristics display 503, an on button 504, a library button 505, a channel player name 506, an EQ simplified characteristics display 507, a bank name display 508, a link button 509, a dynamics simplified characteristics display 510, a bank name display 511, a dynamics simplified characteristics display 512, and a bank name display 513. Although the channel viewer of FIG. 5 only displays the main configuration related to the present invention, in practice, a larger number of buttons and the like are displayed.

The channel name 501 displays a name of an input channel. In this example, the input channel 4 is displayed, and any name (a cast name of Jullie in this example) that a user has inputted is displayed. In addition, the channel player name 506 displays a channel name and a player (Player) name. For example, a theatrical play, a musical, or the like needs a large number of casts, and a player corresponding to each of the casts is present. A user can input a cast name (a role) to a channel name. Accordingly, the user can easily understand to which cast the channel viewer currently displays the content of signal processing related.

Figure 6:
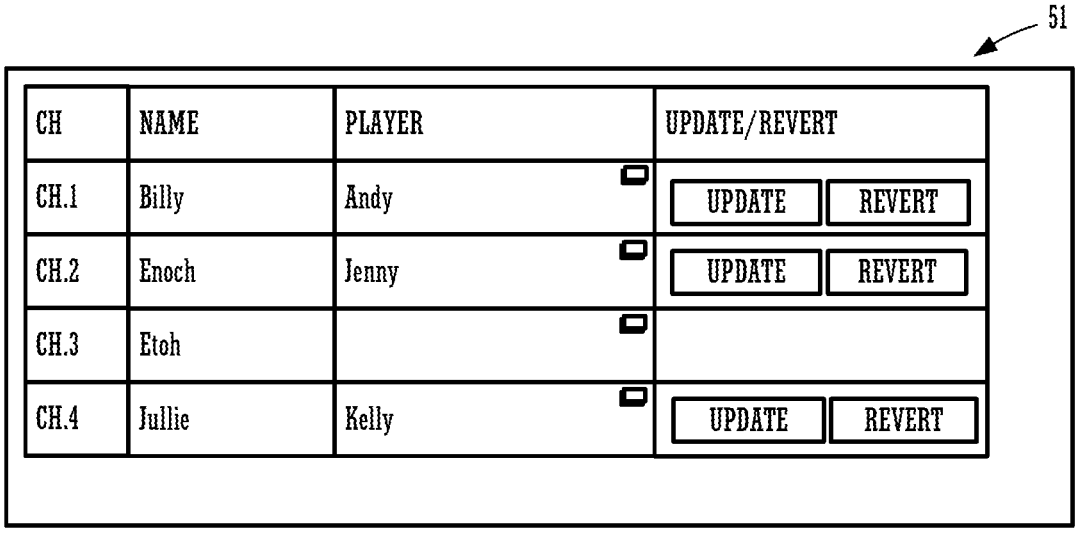
FIG. 6 shows an example of a channel name edit screen.

The name of an input channel is inputted to the channel name edit screen shown in FIG. 6. For example, a user holds down the channel player name 506, the channel name edit screen shown in FIG. 6 is displayed. The channel name edit screen displays "NAME," "PLAYER," and "UPDATE/REVERT" columns for each channel. A user can change a cast name by editing the "NAME" column shown in FIG. 6.

On the channel name edit screen, a predetermined player is able to be assigned to the "PLAYER" column. When a user holds down each player name in the "PLAYER" column, the screen is shifted to the library screen shown in FIG. 7. Alternatively, when the library button 505 shown in FIG. 5 is held down, the screen is shifted to the library screen shown in FIG. 7.

Figure 7:
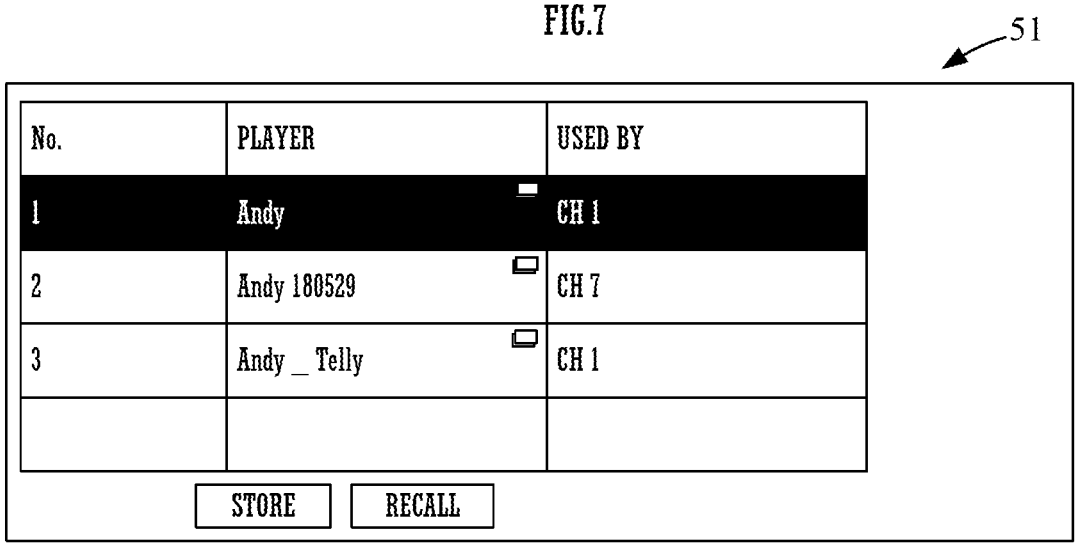
FIG. 7 shows an example of a library screen.

The library screen displays a list of player names. In addition, in a column on the right side of each player, a channel name that has been associated with the player and used in the past is displayed. The user selects any one of the player names from the list of player names on the library screen. In the example of FIG. 7, "Andy" in No. 1 is selected.

When the user presses the "STORE" button, the CPU 18 saves in the flash memory 19 content (current data) of the current signal processing as library data. The library data includes information that indicates a selection channel and a parameter value in each signal processing. A user can save and manage the content of signal processing that has been set in a rehearsal, for example, for each player. It is to be noted that it is not necessary to store the scene data, the current data, and the library data in the flash memory 19 of the own device. For example, the data may be downloaded each time from another device such as a server and may be read out to the RAM 20.

In a case in which the library data is saved in the past, a user selects a player name and can press the "RECALL" button. When the user presses the "RECALL" button, the CPU 18 reads the library data of a selected player and overwrites the current data. As described above, in the present preferred embodiment, a parameter value is not included in the scene data but is included in the library data. When the user recalls the library data, the current data is overwritten.

In a theatrical play, a musical, or the like, one player plays as one cast. Therefore, when the mixer 1 is used for theatrical play, a musical, or the like, the content of signal processing of each channel is preferably saved and managed not for each scene but for each player. However, in the present preferred embodiment, the scene data includes the information on a bank to be used. Therefore, when the scene data is recalled, the bank to be used is switched and the content of signal processing is also switched.

In addition, in a theatrical play, a musical, or the like, the same cast may be played by a different player (a substitute). For a different player, the content of signal processing may be changed in many cases. In addition, even for the same player, differences in various situations, such as different voice tones from day to day or use of a microphone of different channels, may change the content of signal processing.

Accordingly, the mixer 1 according to the present preferred embodiment is able to save and manage the content of signal processing for each player, each date, or each substitute, on the library screen.

Returning to FIG. 6, the channel name edit screen displays a player selected for each channel. The "UPDATE" button and the "REVERT" button are displayed on the channel for which the player is selected. The "UPDATE" button and the "REVERT" button are not displayed on the channel for which the player is not selected.

When a user presses the "UPDATE" button, the name (the cast name) of the channel is saved and the name of the player to be associated with the channel is also saved. Such information is saved in the flash memory 19. It is to be noted that, when a user presses the "REVERT" button, the screen returns to an immediately preceding state. For example, in a case in which a different player has been selected in the immediately preceding state, the screen returns to a state to select the different player.

Returning to FIG. 5, the channel viewer displays in a center the characteristics display 503, the on button 504, the EQ simplified characteristics display 507, the bank name display 508, the link button 509, the dynamics simplified characteristics display 510, the bank name display 511, the dynamics simplified characteristics display 512, and the bank name display 513. In other words, the central area of the channel viewer is a display column about EQ and dynamics processing.

The characteristics display 503 displays frequency characteristics of the equalizer that processes an audio signal of a current channel (CH. 4 in this example). A user, whenever pressing the on button 504, can switch ON and OFF of the EQ and dynamics processing. When the on button 504 is turned on, processing of the equalizer, the dynamics 1 (GATE in this example), and the dynamics 2 (COMP in this example) is performed on the audio signal of the current channel. When the on button 504 is turned off, the processing of the equalizer, the dynamics 1 (GATE in this example), and the dynamics 2 (COMP in this example) on the audio signal of the current channel is canceled (the audio signal is ignored). However, the on button 504 may be individually provided only for the equalizer or for each processing. In addition, the equalizer and an attenuator (ATT) may be linked with ON and OFF of the on button 504.

Under the characteristics display 503, the EQ simplified characteristics display 507, the bank name display 508, and the link button 509 are displayed in an EQ column.

A user specifies any one bank by pressing a bank button of the bank name display 508. Each bank is associated with each of the characteristics of the equalizer. When the user performs specification operation to specify any one bank, the current characteristics of the equalizer is switched to characteristics of the equalizer corresponding to a specified bank.

As described above, the CPU 18 and the DSP 14 perform signal processing based on a parameter value in the current data. The RAM 20 according to the present preferred embodiment correspondingly stores current data for each bank, as a plurality of parameter sets. The CPU 18 and the DSP 14, in a case of receiving specification operation to specify a parameter set to be used, perform signal processing based on a specified parameter set (the current data of the specified bank).

It is to be noted that the current data for each bank may be stored in the flash memory 19. In such a case, the CPU 18, when receiving the specification operation of a bank, reads out the current data of the specified bank from the flash memory 19 and overwrites the current data of the RAM 20. However, the CPU 18, when the current data for each bank is previously loaded into the RAM 20, may only change current data to be used, among loaded current data. In such a case, the CPU 18 is able to change the content of signal processing at an extremely high speed, compared with a case of reading out the current data from the flash memory 19 each time, which reduces the load according to a change in signal processing.

Similarly, the column of the dynamics 1 also displays the dynamics simplified characteristics display 510 and the bank name display 511, and the column of the dynamics 2 also displays the dynamics simplified characteristics display 512 and the bank name display 513.

The user, by pressing a bank button of the bank name display 511 and specifying any one bank, can change the content of the dynamics 1. In addition, a user, by pressing a bank button of the bank name display 513 and specifying any one bank, can change the content of the dynamics 2.

It is to be noted that the link button 509 is displayed between the EQ column and the dynamics column. When a user turns on the link button 509, the bank in the EQ column and the bank in the dynamics column link to each other. In other words, when the link button 509 is turned on, all banks of the EQ, the dynamics 1, and the dynamics 2 are changed to the same bank. For example, when a bank A is specified in the bank name display 508, the bank of the dynamics 1 and the dynamics 2 is also specified to the bank A.

The EQ simplified characteristics display 507, the dynamics simplified characteristics display 510, and the dynamics simplified characteristics display 512 display an image that shows simple characteristics corresponding to each bank. For example, the EQ simplified characteristics display 507 displays frequency characteristics. The dynamics simplified characteristics display 510 and the dynamics simplified characteristics display 512 display a level relationship between input and output. Therefore, the user, when changing a bank, can easily determine resulting characteristics of signal processing after switching.

In this manner, a user can change the content of signal processing by performing the specification operation of a bank. A user may perform the specification operation of a bank each time and can also specify a bank as a read-out instruction of scene data. As described above, the scene data includes information (information that indicates a parameter set corresponding for each scene) that indicates a bank to be used. Therefore, the CPU 18 and the DSP 14, when receiving read-out instruction to read out scene data, switch current data to the current data of a bank to be used and change the content of signal processing, based on the scene data.

Figure 8:
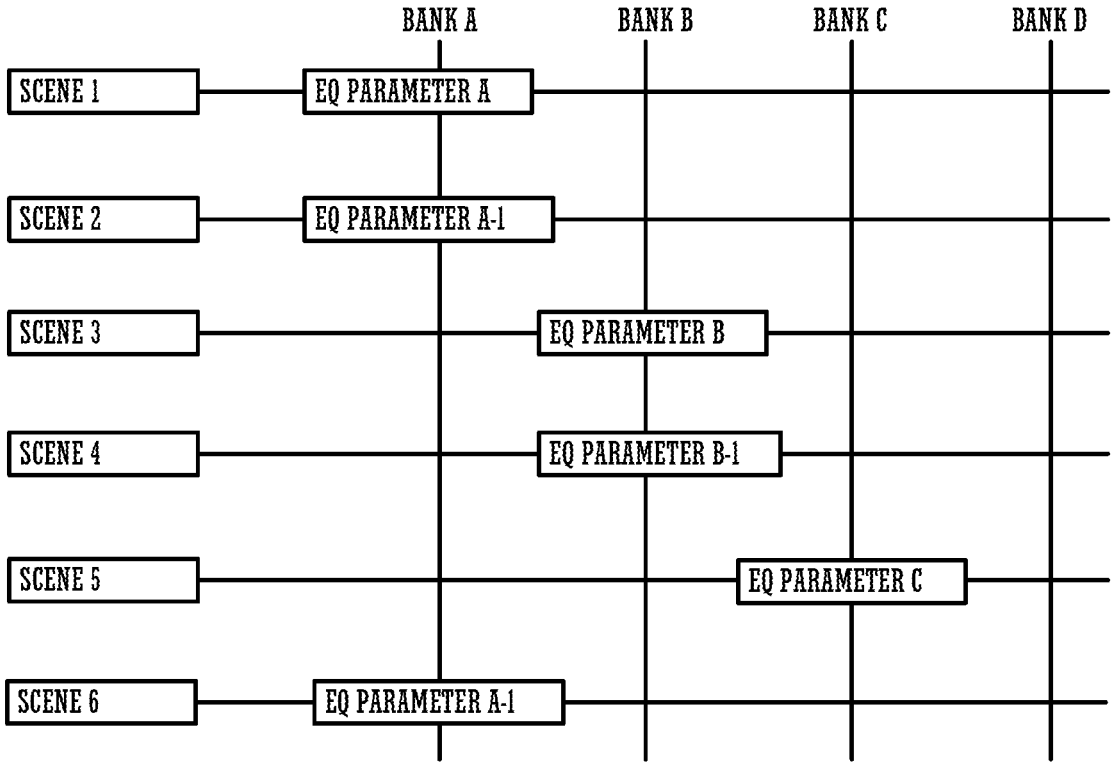
FIG. 8 is a conceptual diagram showing a relationship of change in a scene, change in a parameter, switching of a bank, and signal processing.

FIG. 8 is a conceptual diagram showing a relationship of change in a scene, change in a parameter, switching of a bank, and signal processing. In the example of FIG. 8, the scene data of a scene 1, a scene 2, and a scene 6 is associated with the bank A. The scene data of a scene 3 and a scene 4 is associated with a bank B. The scene data of a scene 5 is associated with a bank C.

In a theatrical play, a musical, or the like, even the same cast and the same player may change the content of signal processing. For example, a sound field environment may change between a rehearsal and an actual play, and the characteristics of an equalizer may be adjusted. In addition, even in a case in which a scene changes, the content of signal processing may be changed. For example, in a case in which a costume changes and a location of a microphone changes, depending on a scene, the content of signal processing needs to be changed. In addition, in a case in which a scene changes, the same costume may be used again. The mixer 1 according to the present preferred embodiment, by changing a bank to be used for each costume, is able to change the content of signal processing even for the same cast and the same player.

In the example of FIG. 8, when a user first recalls the scene data of the scene 1, signal processing is performed with the current data of the bank A. In the present preferred embodiment, signal processing is performed with a value of an EQ parameter A as the current data of the bank A.

Next, a user adjusts the characteristics of an equalizer in the scene 2. When the user adjusts an EQ parameter, current data is changed. In this example, in the scene 2, the user adjusts the EQ parameter A to an EQ parameter A-1. Therefore, the current data of the bank A is updated at this point.

Subsequently, when a user recalls the scene data of the scene 3, signal processing is performed with the current data of the bank B. In other words, in the scene 3, signal processing is performed with an EQ parameter B. In addition, in the scene 4, the user adjusts the EQ parameter B to an EQ parameter B-1. Therefore, in the scene 4, the current data of the bank B is updated.

Subsequently, when a user recalls the scene data of the scene 5, signal processing is performed with the current data of the bank C. In this example, signal processing is performed with an EQ parameter C.

When a user recalls the scene data of the scene 6, signal processing is performed with the current data of the bank A. The current data of the bank A is updated to the EQ parameter A-1 in the scene 2. Therefore, when the scene data of the scene 6 is recalled, signal processing is performed with a parameter value of the EQ parameter A-1.

In the present preferred embodiment, a parameter value is stored as library data, and the scene data includes only information on a bank to be used and does not include the parameter value. Accordingly, even in a case in which a scene is changed, the current data is maintained. Therefore, even when a scene changes and a costume of a player changes back to the original costume, adjusted content of signal processing is able to be used continuously.

A user, in a case of desiring to save an adjusted parameter value, on the library screen shown in FIG. 7, overwrites the library data with the current data by pressing the STORE button, or inputs a player name by setting current data as new library data and presses the STORE button. In a case of reproducing (undoing) a state before adjustment, a user presses the RECALL button on the library screen shown in FIG. 7.

Figure 9:
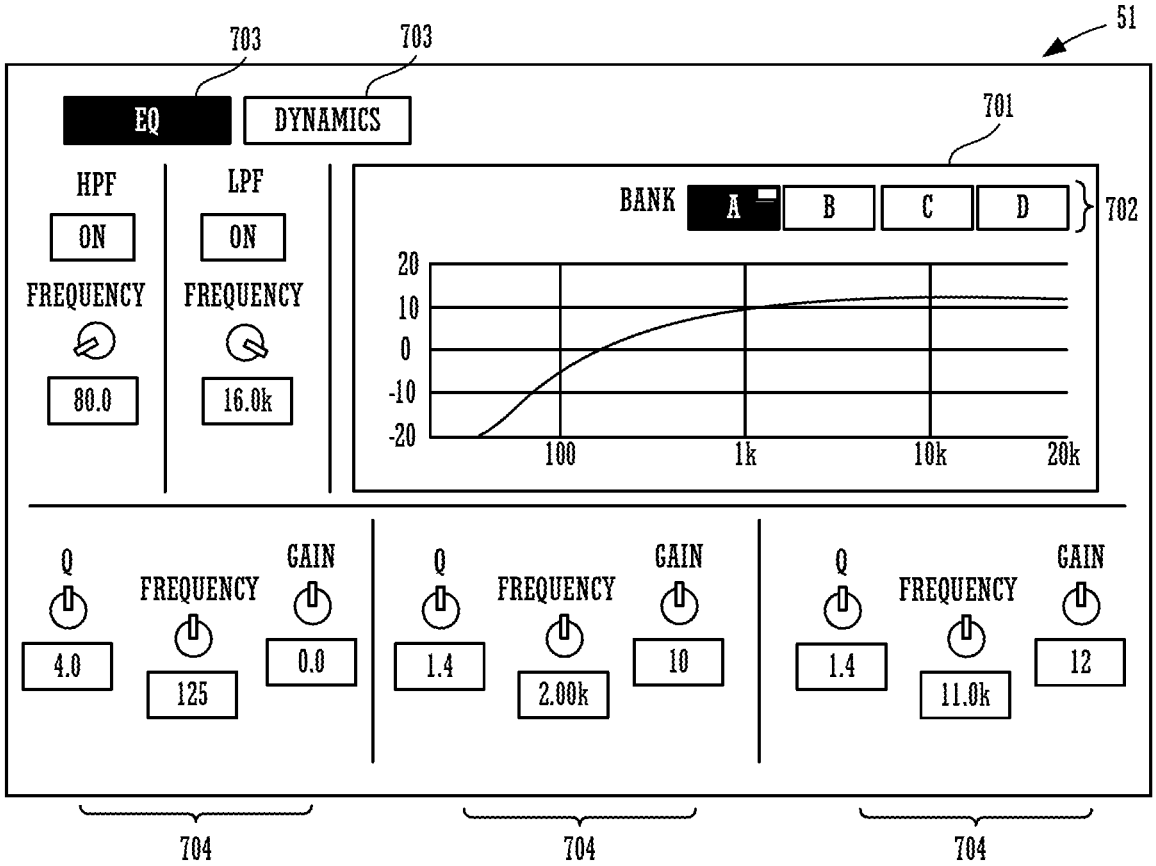
FIG. 9 is a view showing an example of a screen for adjusting content of signal processing.

FIG. 9 is a view showing an example of a screen for adjusting content of signal processing. FIG. 9 shows an EQ edit viewer as an example. For example, when a user holds down the characteristics display 503 in FIG. 5, the EQ edit viewer shown in FIG. 9 is displayed.

The EQ edit viewer displays an EQ characteristics screen 701, a bank name display 702, a switch button 703, and a physical controller group 704. When a user presses the switch button 703, the screen shifts to an EQ edit viewer, a dynamics edit viewer, or another signal processing edit screen that correspond to the button.

The user can adjust the content of signal processing by operating the physical controller group 704 while checking EQ characteristics on the EQ characteristics screen 701. The EQ characteristics screen 701 displays a bank name display 702. Therefore, the user can easily understand of which bank the signal processing is currently adjusted.

It is to be noted that a user can freely edit a bank name. For example, when a user holds down the bank name displays 508, 511, and 513 of FIG. 5, the screen shifts to a not-shown bank name edit screen. In addition, when a user holds down the bank name display 702 in the EQ characteristics screen 701, the screen may shift to the bank name edit screen. When a user inputs a bank name to the bank name edit screen, the display of the bank name displays 508, 511, 513, and 702 is changed.

Figure 10:
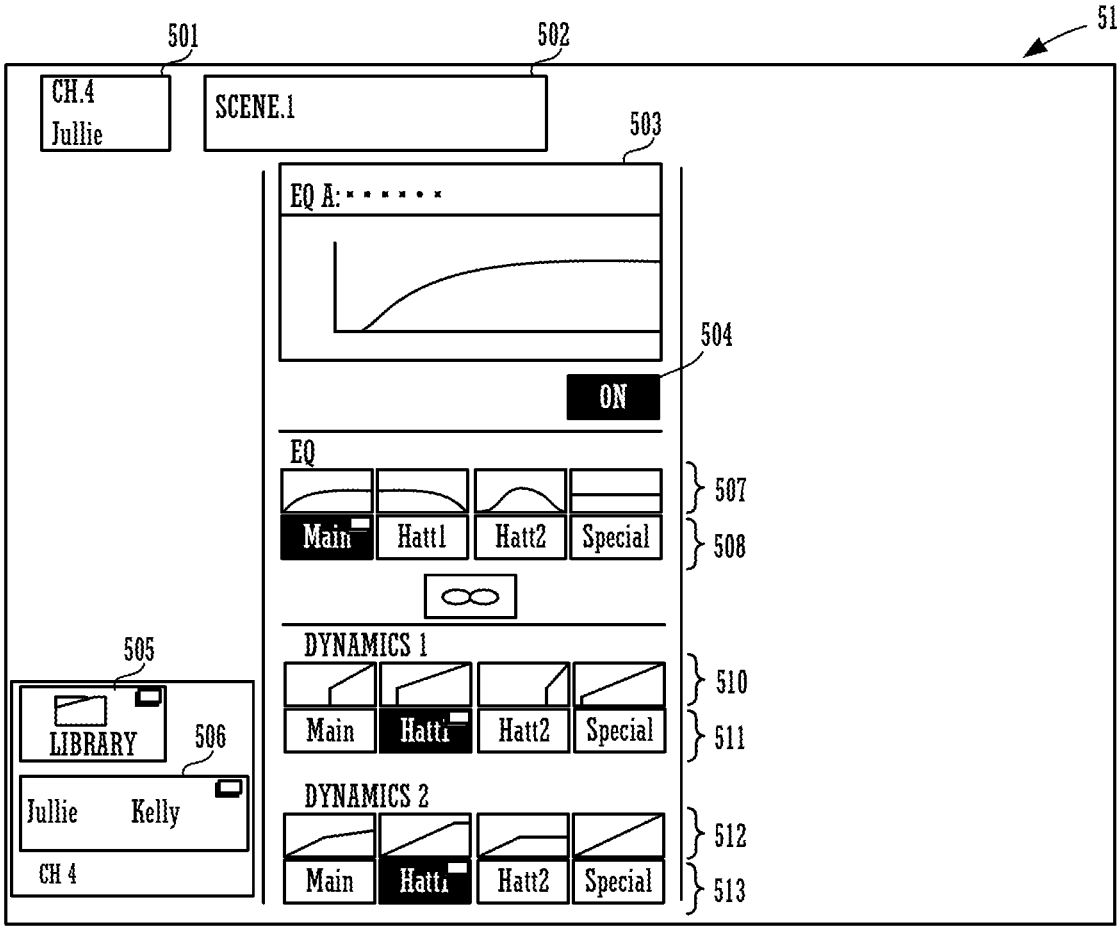
FIG. 10 is a view showing an example of a display when a bank name is inputted.

For example, as shown in FIG. 10, the descriptions of the banks A, B, C, and D in the bank name displays 508, 511, and 513 are changed to the displays of "Main," "Hatt1," "Hatt2," and "Special," respectively. Accordingly, the user can easily understand the use (a costume name, for example) of each bank.

Figure 14:
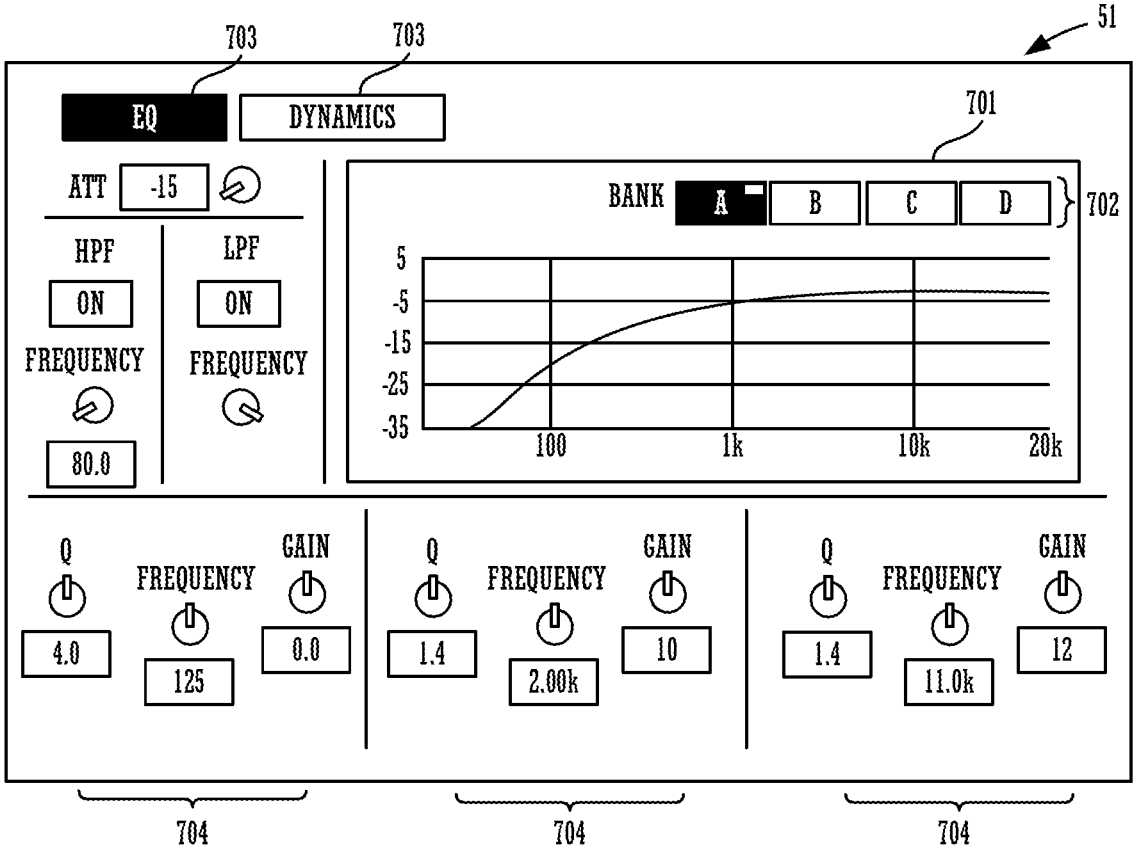
FIG. 14 is a view showing an example of a screen for adjusting content of signal processing.

The EQ edit viewer, as shown in FIG. 14, may display a value of the ATT and may display a screen on which the value of the ATT is adjusted. In a case in which the ATT and the equalizer are linked with each other, when a user changes a bank, the value of the ATT is also changed in response to a change in the EQ characteristics.

In addition, in the example of FIG. 14, a center position in the vertical direction of the EQ characteristics screen 701 changes in accordance with the value of the ATT. In the example of FIG. 14, the value of the ATT is −15 dB. Therefore, the center position in the vertical direction of the EQ characteristics screen 701 is set to −15 dB. Alternatively, as shown in FIG. 9, the center position in the vertical direction may be 0 dB. In such a case, the EQ characteristics that are displayed on the EQ characteristics screen 701 may move vertically in accordance with the value of the ATT.

It is to be noted that, in either of the examples of FIG. 9 and FIG. 14, a user may adjust the content of signal processing by touching the EQ characteristics on the EQ characteristic screen 701. For example, when a user swipes the EQ characteristics of the EQ characteristic screen 701 upward by only −5 dB, the value of the ATT changes to −10 dB.

Figure 11:
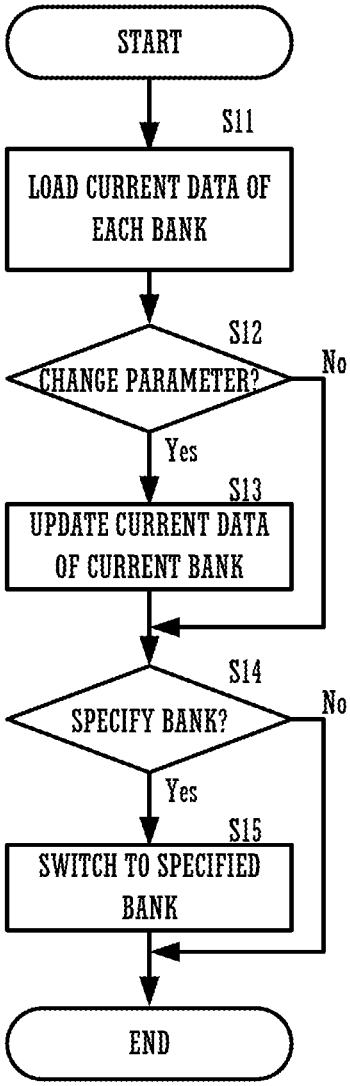
FIG. 11 is a flow chart showing operation of the mixer 1.

FIG. 11 is a flow chart showing operation of the mixer 1. As shown in FIG. 11, the CPU 18 first loads current data of each bank in the RAM 20 (S11). The processing corresponds to storing a plurality of parameter sets in a storage (the RAM) in the present invention.

The current data is transferred to the flash memory 19 when the power is off. When the power is on, the current data loaded into the RAM 20 is restored immediately before the power is off. In addition, on the library screen of FIG. 7, when the RECALL button is pressed, the library data is overwritten to the current data.

The CPU 18, when receiving change operation to change a parameter value (YES in S12), updates the current data of the current bank (S13). Without the change operation of a parameter value, the processing of S13 is not performed. The processing, in the present invention, corresponds to receiving the change operation of a parameter value included in a parameter set, and, when receiving the change operation, updating a currently used parameter set among the plurality of parameter sets stored in the storage (the RAM).

The CPU 18, when receiving the specification operation of a bank (YES in S14), switches current data to the current data of a specified bank, and changes the content of signal processing (S15). This processing, in the present invention, corresponds to receiving specification operation to specify a parameter set to be used among a plurality of parameter sets and processing an audio signal based on the parameter set specified by the specification operation.

Figure 12:
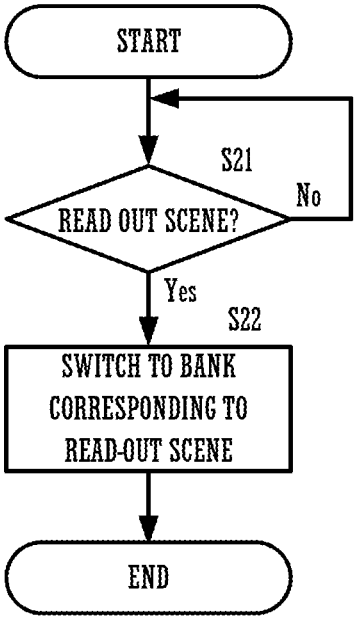
FIG. 12 is a flow chart showing operation of the mixer 1.

FIG. 12 is a flow chart showing operation of the mixer 1 when scene data is read out. The CPU 18, when receiving read-out instruction to read out scene data (YES in S21), switches current data to the current data of the bank corresponding to read-out scene data, and changes the content of signal processing (S22).

Figure 13:
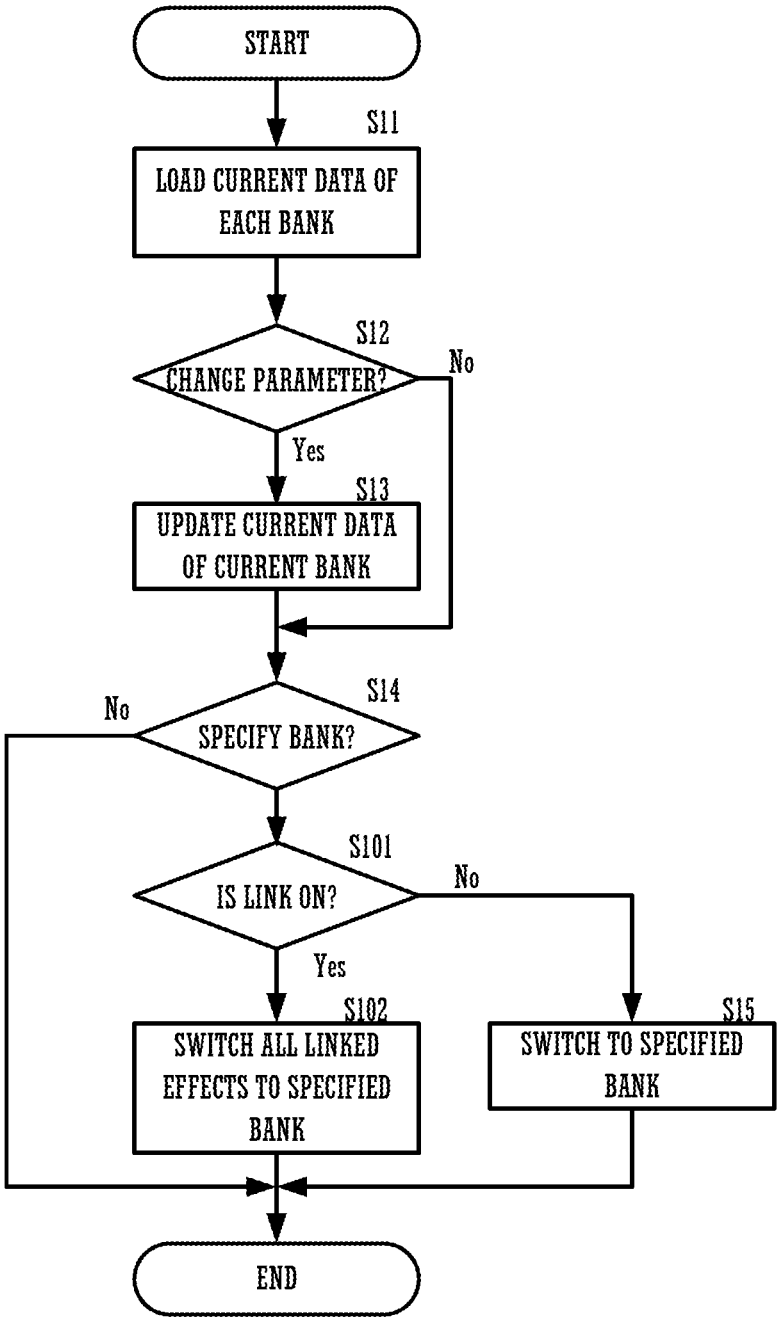
FIG. 13 is a flow chart showing operation of the mixer 1.

FIG. 13 is a flow chart showing operation of the mixer 1 in a case in which a link function is enabled. Like reference numerals are used to refer to processing common to FIG. 11, and the description is omitted. The CPU 18, when receiving the specification operation of a bank (YES in S14), determines whether or not the link button 509 is turned on (S101). When the link button 509 is turned off (NO in S101), the CPU 18 switches current data to the current data of the specified bank and changes the content of signal processing (S15).

On the other hand, the CPU 18, when the link button 509 is turned off (YES in S101), switches all linked effects to the specified bank and changes the content of signal processing (S102). For example, when the bank A is specified in any of the EQ, the dynamics 1, and the dynamics 2 of FIG. 5, the bank A is specified in all the EQ, the dynamics 1, and dynamics 2.

Finally, the foregoing preferred embodiments are illustrative in all points and should not be construed to limit the present invention. The scope of the present invention is defined not by the foregoing preferred embodiments but by the following claims. Further, the scope of the present invention is intended to include all modifications within the scopes of the claims and within the meanings and scopes of equivalents.

For example, in the present preferred embodiment, the touch screen 51 displays a button for receiving bank specification. However, for example, any hardware button on a console may receive the bank specification. In addition, on the touch screen 51, while an example in which a currently specified bank is highlighted is shown, any display mode may be used as long as the display mode is different from a display mode of other banks. For example, an LED may be installed in each hardware button on a console, and the LED of a currently specified bank may be turned on while the LED of other banks may be turned off.

What is claimed is:

1. An audio signal processing apparatus comprising:

a storage storing:

a plurality of parameter sets as current data of each of a plurality of banks;

scene data including information that specifies a bank among the plurality of banks;

a receptor that receives:

a read-out instruction to read out the scene data of a specified bank among the plurality of banks; and a change operation to change a parameter value of the current data of the specified bank specified by the received read-out instruction;

a signal processor that processes an audio signal based on the current data of the specified bank; and an update processor that updates the current data of the specified bank upon the receptor receiving the change operation.

2. The audio signal processing apparatus according to claim 1, wherein:

the current data of each of the plurality of banks includes a parameter value of each of a plurality of types of signal processing, and the signal processor, upon the receptor receiving the read-out instruction, reads out a parameter value of the plurality of types of signal processing included in the current data of the specified bank, and processes the audio signal.

3. The audio signal processing apparatus according to claim 1, further comprising a plurality of physical controllers respectively corresponding to the current data of each of the plurality of banks.

4. The audio signal processing apparatus according to claim 3, wherein a physical controller corresponding to the current data of the currently specified bank, among the plurality of physical controllers, is displayed in a display mode that is different from a display mode of other physical controllers, among the plurality of physical controllers.

5. The audio signal processing apparatus according to claim 3, wherein:

the receptor receives the specification operation by receiving operation to any one of the plurality of physical controllers, and the specification operation is for specifying a bank among the plurality of banks by a user.

6. The audio signal processing apparatus according to claim 1, further comprising a display that displays information that indicates content of processing the audio signal.

7. The audio signal processing apparatus according to claim 6, wherein the display displays an image for receiving the specification operation.

8. The audio signal processing apparatus according to claim 6, wherein:

the receptor receives a selection of an input channel; and the display displays a parameter setting screen of a selected input channel, and, on the parameter setting screen, displays information that indicates content of signal processing according to the current data of each of the plurality of banks.

9. The audio signal processing apparatus according to claim 1, wherein:

the storage stores library data, the receptor receives a store instruction and a recall instruction;

the update processor:

stores, in the storage, the current data as the library data upon the receptor receiving the store instruction, and overwrites the current data with the library data upon the receptor receiving the recall instruction.

10. An audio signal processing method comprising:

storing, in a storage:

a plurality of parameter sets as current data of each of a plurality of banks;

scene data including information that specifies a bank among the plurality of banks;

receiving:

a read-out instruction to read out the scene data of a specified bank among the plurality of banks; and a change operation to change a parameter value of the current data of the specified bank specified by the received read-out instruction;

processing an audio signal based on the current data of the specified bank; and updating the current data of the specified bank upon the receiving the change operation.

11. The audio signal processing method according to claim 10, wherein:

the current data of each of the plurality of banks includes a parameter value of each of a plurality of types of signal processing, and the processing, upon the receiving the read-out instruction, reads out a parameter value of the plurality of types of signal processing included in the current data of the specified bank, and processes the audio signal.

12. The audio signal processing method according to claim 10, wherein:

the receiving receives the specification operation by receiving operation to any one of a plurality of physical controllers, and the specification operation is for specifying a bank among the plurality of banks by a user.

13. The audio signal processing method according to claim 12, further comprising displaying, on a display, a physical controller corresponding to the current data of the currently specified bank, among the plurality of physical controllers, in a display mode that is different from a display mode of other physical controllers, among the plurality of physical controllers.

14. The audio signal processing method according to claim 10, further comprising displaying, on a display, information that indicates content of processing the audio signal.

15. The audio signal processing method according to claim 14, wherein the displaying displays an image for receiving the specification operation.

16. The audio signal processing method according to claim 14, wherein:

the receiving receives a selection of an input channel;

the displaying displays a parameter setting screen of a selected input channel, and on the parameter setting screen, displays information that indicates content of signal processing according to the current data of each of the plurality of banks.

17. The audio signal processing method according to claim 10, wherein:

the storing stores library data, the receiving receives a store instruction and a recall instruction, and the updating:

stores, in the storage, the current data as the library data upon the receiving receiving the store instruction; and overwriting the current data with the library data upon the receiving receiving the recall instruction.

18. A non-transitory readable storage medium storing a program executable by a computer to execute an audio signal processing method comprising:

storing, in a storage:

a plurality of parameter sets as current data of each of a plurality of banks;

scene data including information that specifies a bank among the plurality of banks;

receiving:

a read-out instruction to read out the scene data of a specified bank among the plurality of banks; and a change operation to change a parameter value of the current data of the specified bank specified by the received read-out instruction;

processing an audio signal based on the current data of the specified bank; and updating the current data of the specified bank among the plurality of banks upon the receiving the change operation.

* * * * *